US005980336A

United States Patent [19]

Hall et al.

[11] Patent Number: 5,980,336

[45] Date of Patent: Nov. 9, 1999

[54] ELECTRICAL TERMINAL

[75] Inventors: Thomas E. Hall, Ft. Wayne; John J. McDonald, Albion; Kevin Rupley, Huntington, all of Ind.

[73] Assignee: Lear Automotive Dearborn, Inc., Southfield, Mich.

[21] Appl. No.: 08/489,272

[22] Filed: Jun. 9, 1995

[51] Int. Cl.[6] ..... H01R 13/187

[52] U.S. Cl. ..... 439/843; 439/852; 439/845

[58] Field of Search ..... 439/842, 843, 439/851–857, 861, 862, 845

[56] References Cited

U.S. PATENT DOCUMENTS

| | | | |
|---|---|---|---|
| 3,713,080 | 1/1973 | Kennedy | 339/258 |
| 3,718,895 | 2/1973 | Reynolds et al. | 339/258 |
| 4,002,400 | 1/1977 | Evans | 439/851 |
| 4,047,791 | 9/1977 | Carter | 339/260 |
| 4,076,369 | 2/1978 | Ostapovitch | 339/258 |
| 4,423,921 | 1/1984 | Hall | 339/256 |
| 4,426,127 | 1/1984 | Kubota | 439/851 |
| 4,460,239 | 7/1984 | Inoue | 339/258 |
| 4,472,017 | 9/1984 | Sian | 339/217 |
| 4,798,545 | 1/1989 | Roy et al. | 439/677 |

FOREIGN PATENT DOCUMENTS

| | | |
|---|---|---|
| 0125927 | 11/1984 | European Pat. Off. . |
| 0218435 | 4/1987 | European Pat. Off. . |

*Primary Examiner*—Paula Bradley
*Assistant Examiner*—Tho Dac Ta
*Attorney, Agent, or Firm*—MacMillan, Sobanski & Todd, LLC

[57] ABSTRACT

An electrical terminal, particularly for use in automotive applications, includes a body portion electrically connected to a connection portion. The body portion has an entry end, an exit end and an interior chamber therebetween. The body portion further has a contact spring member within the interior chamber for pressing a male blade into electrical contact with the body portion and hence, into electrical connection with the wire connection portion.

1 Claim, 6 Drawing Sheets

14
"A"
"B"
58
66
74
74b
75
64a
73
53
72
50
60
62
32
44
64
64b
34
52
P1
P2
α

ELECTRICAL TERMINAL

TECHNICAL FIELD

The present application relates to electrical terminals and more particularly, to an electrical terminal for use in the automotive industry exhibiting relatively low insertion forces and removal forces substantially equal to or greater than the insertion force.

BACKGROUND ART

In the automotive industry electrical connectors are used for a variety of applications. In particular, electrical connectors are utilized in automotive vehicle electrical systems where it is common to have the electrical connectors disposed between a pair of discrete wires. It is also known to provide electrical connectors between a discrete wire and a male conductive blade or, alternatively, between a pair of male conductive blades. Conventional connectors utilized with male members have a barrel or box-like shape for receiving the male member. Examples of such conventional electrical connectors are disclosed in the following U.S. Pat. No. 4,798,545 entitled "Electrical Terminal Receptacle and Electrical Component Housing Adapted for the Same" issued on Jan. 17, 1989 to Roy et al.; U.S. Pat. No. 4,531,808 entitled "Blade Coupling Terminal" issued on Jul. 30, 1985 to Cairns et al.; U.S. Pat. No. 4,460,239 entitled "Connector Terminal" issued on Jul. 17, 1984 to Inoue; and U.S. Pat. No. 4,451,109 entitled "Connector Terminal" issued on May 29, 1994 to Inoue. The above referenced patents are incorporated by reference herewithin.

Another type of electrical connector which has been employed within the automotive industry consists of four side walls folded in a box-like manner having a conductive tail member extending therefrom, the conductive tail is able to be crimped onto a discrete wire. In this configuration a pair of flexible beams project within the box from respective generally parallel walls. Each beam is substantially flat with a single, central slot extending along substantially the entire longitudinal length of the beam.

Conventional electrical connectors have many limitations. The blade formations of conventional constructions create high insertion efforts of the male blade therein. As the male blade is inserted it causes each beam to compress beyond the plastic elasticity of the beam material such that each beam is then given a permanent compressed set. Thus, once insertion is achieved the compressive forces holding the male blade in contact with the female connector are minimal and the male blade may inadvertently disengage from the female electrical connector.

What is therefore needed in the art is an improved electrical terminal for use in the automotive industry exhibiting low insertion forces of a male blade member and extraction forces of the male member substantially equal to, or greater than the insertion force.

SUMMARY

An electrical terminal for use with a blade member is provided, the electrical terminal including a body portion having an interior chamber. The body portion includes: an entry end; an exit end opposed to the entry end; and a contact spring member substantially disposed within the interior chamber. The contact spring member is movable upon insertion and removal of the blade member. The contact spring member includes a primary pivot point; a secondary pivot point; and a curved portion adjacent the exit end. Insertion of the blade member into the interior chamber causes the blade member to the spring member to pivot about the primary pivot point, and the secondary pivot point.

BRIEF DESCRIPTION OF THE DRAWING

Various embodiments are described herein with reference to the drawings wherein.

These figures are meant to be exemplary and not to limit the generally broad scope of the present application.

DETAILED DESCRIPTION OF THE PREFERRED EMBODIMENTS

As used herein with reference to the present application, the term "preloaded" shall refer to an electrical terminal which includes a contact spring member that has been placed under stress. The term "sized" as used herein shall refer to a contact spring member that has been conditioned by intentionally overstressing the spring member by use of a sizing blade, preferably during manufacture, to overcome a first insertion spike, which would be higher than desired.

Figure 1:
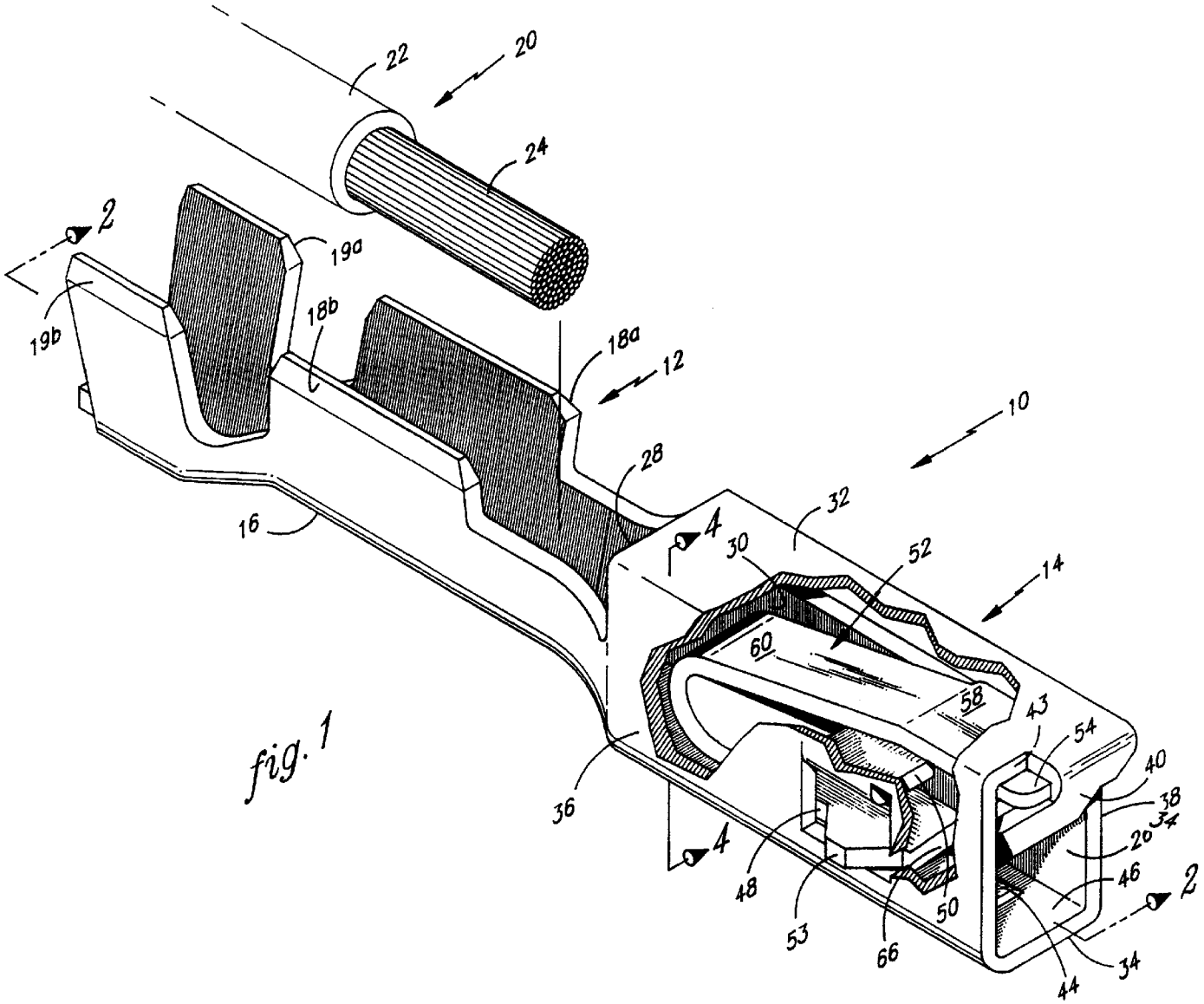
FIG. 1 is a perspective view of one embodiment of an electrical terminal of the present application partially broken away for clarity.

Referring now to FIG. 1, there is illustrated a perspective view of one embodiment of an electrical terminal 10 of the present application partially broken away for clarity and showing the electrical terminal 10 in a preloaded and sized state. The electrical terminal 10 is operatively associated with a male blade member 74 (FIGS. 5A–5F) and includes a wire connection portion 12 and a body portion 14. The wire connection portion 12 preferably includes a base 16 and at least one wire tab extending therefrom. In the present embodiment, wire connection portion 12 preferably includes a proximal set of wire tabs 18*a,b* and a distal set of wire tabs 19*a, b*. Wire tabs 18*a, b* and 1 base 16, are initially set in an open configuration as shown in FIG. 1, and operate to hold an electrically conductive wire 20 in electrical contact with base 16.

Conductive wire 20 includes an outer insulation sheath 22 which is substantially disposed about at least a portion of a conductive core 24. After placing conductive wire 20 in contact with base 16, wire tabs 18*a,b* are crimped into a closed position around the conductive core 24 and wire tabs 19*a,b* are crimped into a closed position around insulation sheath 22. Conductive core 24 is thereby held in electrical contact with base 16 by the wire tabs 18*a, b* and 19*a,b*. In the present embodiment tabs 18*a, b* and 19*a,b* are generally U-shaped; however, the shape of the wire tabs may be changed to coincide with the conductive wire used provided that electrical contact between the base 16 and conductive core 24 is maintained.

With continued reference to FIG. 1, body portion 14 is preferably box-like in shape and includes an entry end 26, an exit end 28 opposed to the entry end, and an interior chamber 30 disposed between entry end 26 and exit end 28. Interior chamber 30 is further defined by a first wall 32, a second wall 34, a third wall 36 and a fourth wall 38.

Figure 6:
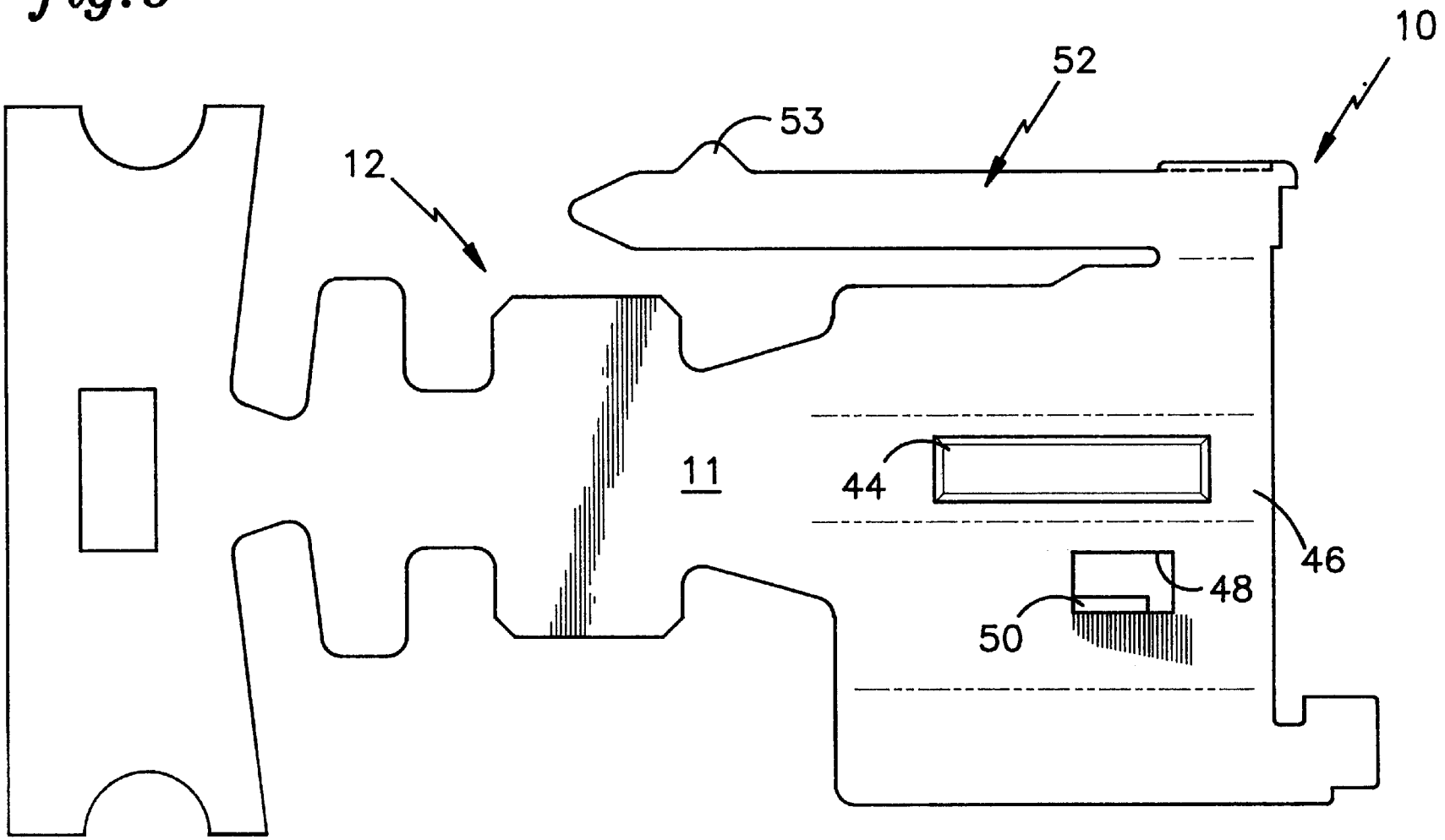
FIG. 6 is a plan view of a sheet metal blank from which the electrical terminal of FIG. 1 is formed.

First wall 32 and second wall 34 are opposing walls which are substantially parallel to one another and spaced a preselected distance from each other. The first wall 32 extends to form an entry flap 40, the entry flap 40 preferably including a notch 43 cut into one corner thereof, adjacent first wall 32. In the present embodiment, the second wall 34 is preferably adjacent to and integral with base 16 of wire connection portion 12 and includes a raised contact surface 44 and a floor surface 46. As shown in FIG. 6, raised contact surface 44 is preferably a singular ridge-shaped member which is disposed higher than the remaining floor surface 46 of the second wall. Alternatively, contact surface 44 may be formed of two or more, substantially parallel, ridge-shaped members.

Figure 2:
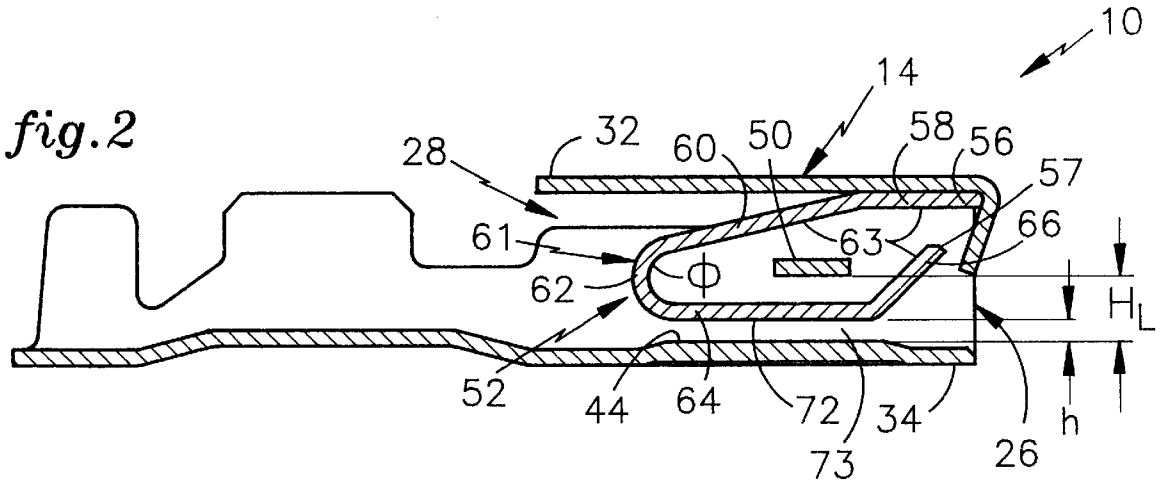
FIG. 2 is a side elevation view along line 2—2 of FIG. 1 of one embodiment of an electrical terminal of the present application.

With continuing reference to FIG. 1, adjacent first and second walls 32, 34 are third and fourth walls 36 and 38, respectively. Third wall 36 and fourth wall 38 are opposed, substantially parallel and spaced at a preselected distance with respect to each other. In the present embodiment, third wall 36 is adjacent and substantially perpendicular to first wall 32 and second wall 34, and includes an opening 48 formed therein. The third wall 36 further includes a lip 50 extending therefrom into the interior chamber 30. The lower surface of the lip 50 provides overstress protection for a contact spring member 52 upon sizing of the contact spring member 52 by insertion of a sizing blade (not shown) as described hereinbelow. As shown in FIG. 2, lip 50 is disposed at a predetermined height $H_L$ from the raised contact surface 44. $H_L$ is determined by the distance contact spring member 52 can travel before becoming overstressed. $H_L$ is determined by the following equation: Maximum desired blade thickness+maximum desired material thickness of contact spring+desired clearance between blade member and contact spring+any applicable manufacturing tolerances as determined by one skilled in the art. The fourth wall 38 is preferably adjacent and substantially perpendicular to the first wall 32 and the second wall 34. In the present embodiment first, second, third and fourth walls are integrally formed as shown in FIG. 6. Alternatively, the walls may be joined together in any known manner, for example welding.

Body portion 14 further includes contact spring member 52 disposed within the interior chamber 30, as shown in FIG. 1. The contact spring member 52 includes a preloading tab 53 and an interlocking tab 54. The preloading tab 53 extends through the opening 48 in the preloaded and sized state as shown and described hereinbelow. The interlocking tab 54 extends through the notch 43 thereby forming a cooperable locking device that is preferably integral with the terminal. When tab 54 is inserted through notch 43 electrical terminal 10 is retained in the closed box-like configuration as shown in FIG. 1.

Figure 3:
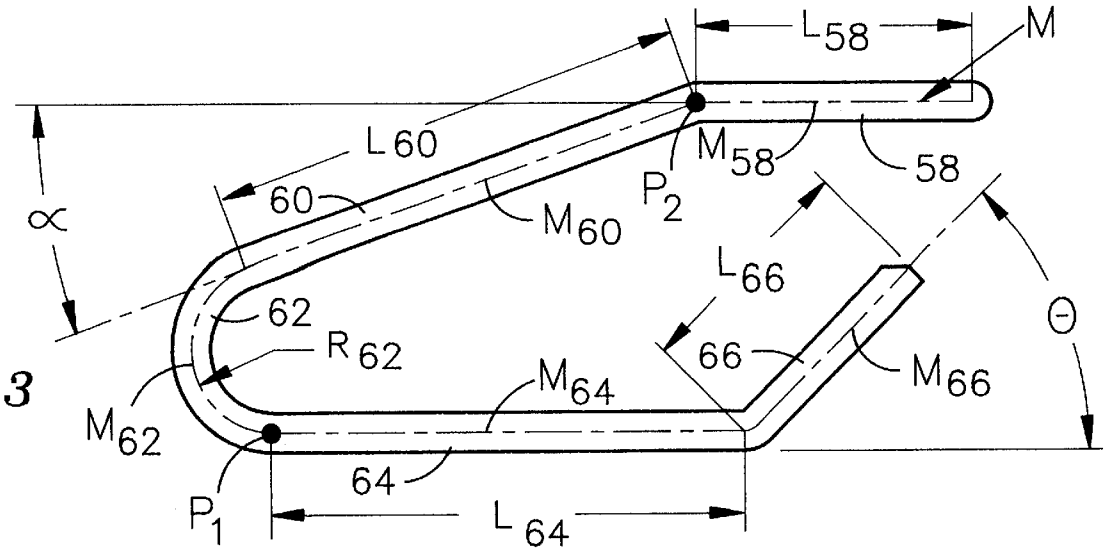
FIG. 3 is an enlarged view of the contact spring member of FIG. 1.

Referring now to FIGS. 2 and 3, a side elevation view in partial cross-section, taken along line 2—2 of FIG. 1 and an enlarged view of the contact spring member 52 of FIG. 2 are shown. As illustrated in FIG. 2, the contact spring member 52 includes a stationary end 56 and a free end 57. Both the stationary end 56 and the free end 57 are adjacent to the entry end 26 of body portion 14. The contact spring member further includes a first portion 58, a second portion 60, a curved portion 62, a contact portion 64, and a loading-ramp portion 66. The first portion 58, second portion 60, curved portion 62, contact portion 64 and loading-ramp portion 66, each have an associated length $L_{58}$, length $L_{60}$, radius $R_{62}$, length $L_{64}$, and length $L_{66}$, respectively. Contact spring member 52 further includes a median axis "M" centrally disposed and extending throughout the length of the contact spring member 52.

In the present embodiment, first portion 58 extends from the stationary end 56 toward the exit end 28 of the body portion 14. The first portion 58 is preferably substantially parallel and adjacent to the first wall 32. The second portion 60 extends from the first portion 58 toward the exit end 28 of the body portion 14 and is preferably disposed at a first angle $\alpha$ with respect to first portion 58. First angle $\alpha$ is measured as the angle between the median axis "$M_{58}$" centrally disposed along the first portion 58 and the median axis "$M_{60}$" centrally disposed along the second portion 60.

With continued reference to FIGS. 2 and 3, curved portion 62 is disposed between the second portion 60 and the contact portion 64. In the present embodiment curved portion 62 has a curvature $\phi$ of about 180°, but may have any curvature which is capable of enabling contact spring member 52 to operate according to the present application as described hereinbelow. Contact portion 64 extends from the curved portion 62 toward the entry end 26 and includes the preloading tab 53 which extends from the contact portion and through the opening 48 (FIG. 1). Loading-ramp portion 66 extends from contact portion 64 toward the entry end 26. The loading-ramp portion 66 is angled away from the second wall 34 at a second angle $\theta$ as shown in FIG. 2. Second angle $\theta$ is measured as the angle between the median axis "$M_{64}$" centrally disposed along the contact portion 64 and the median axis "$M_{66}$" centrally disposed along the loading-ramp portion 66.

With continuing reference to FIG. 2, contact spring member 52 is preferably a unitary structure having an exterior surface 61 and an interior surface 63 defined by the exterior and interior surfaces, respectively, of portions 58, 60, 62, 64, and 66 in the present embodiment. The exterior surface of contact portion 64 defines exterior contact surface 72 which prior to insertion of blade member 74 (FIG. 5A) is substantially parallel to raised contact surface 44. The exterior contact surface 72 and the raised contact surface 44 define a blade pathway 73. The blade pathway 73 may have a variable height represented in the present embodiment by the letter "h" to accommodate a variety of blade member 74 thickness within a certain range. In the present embodiment, the blade pathway has been designed to accept a 0.58–0.86 mm blade member, but this is merely exemplary as "h" may readily be designed by one skilled in the art to accept wide variety of blade members.

Referring again to FIG. 3, contact spring member 52 is preferably designed to react in a "toggle" movement upon insertion of male blade 74 (FIGS. 5A–5F). The "toggle" movement is optimized when the length of the second portion $L_{60}$ is substantially equal to the length of the contact portion $L_{64}$ and is further enhanced by the positioning of primary and secondary pivot points $P_1$ and $P_2$, respectively, on contact spring member 52. Pivot point $P_2$ is disposed at the interface of the first portion 58 and the second portion 60, while pivot point $P_1$ is disposed at the interface of the curved portion 62 and the contact portion 64. The placement of the pivot points $P_2$ and $P_1$ may be readily determined by one of skill in the art based upon the size and shape of the contact spring member relative to the size and shape of the male blade member along with the desired insertion and removal forces.

Figure 4A:
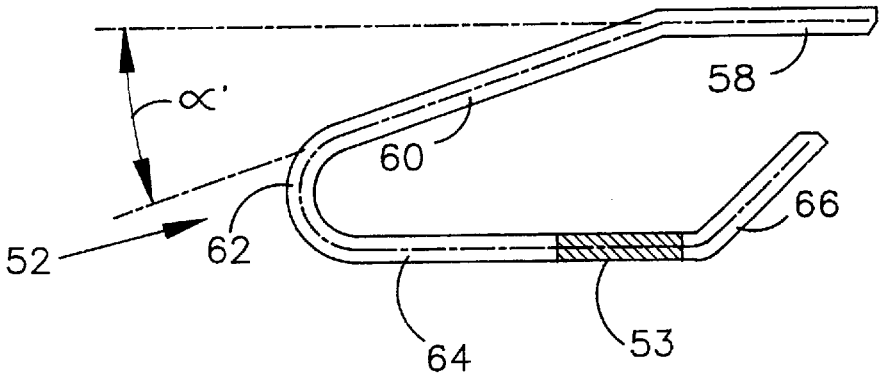
FIGS. 4A, B and C, are partial views of the body portion of the electrical terminal of FIG. 1 in various stages of manufacture.

Referring now to FIGS. 4A, B and C, there is illustrated partial plan side views of the body portion 14 of the electrical terminal of FIG. 2 in various stages of manufacture. FIG. 4A shows the contact spring member 52 in its initial, free-formed state prior to formation of box-like body portion 14. During manufacture the contact spring member 52 is folded into a free-formed state immediately prior to being formed into the box-like configuration, as shown in FIG. 4A. In its free-formed state, contact spring member 52 includes first angle α', measured between the medium axis $M_{58}$ of first portion 58 and the median axis $M_{60}$ of second portion 60 and further includes the preloading tab 53 (not shown).

Figure 4B:
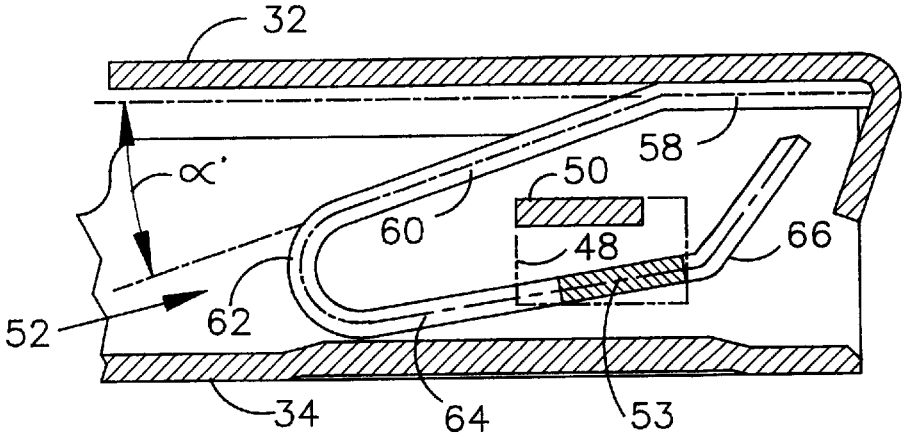

FIG. 4B illustrates the contact spring member 52 in its preloaded state. As body portion 14 is formed, free-formed contact spring member is preloaded by moving the preloading tab 53 into the opening 48; thereby causing the preloading tab 53 to exert a normal force against the third wall 36. As the preloading tab is moved into the opening 48 the contact portion 64 and the associated loading-ramp portion 66 are pivoted about the primary pivot point $P_1$. In the preloaded state contact spring member 52 preferably does not pivot about pivot point $P_2$, thereby the first angle α' does not change from the free-formed state.

Figure 4C:
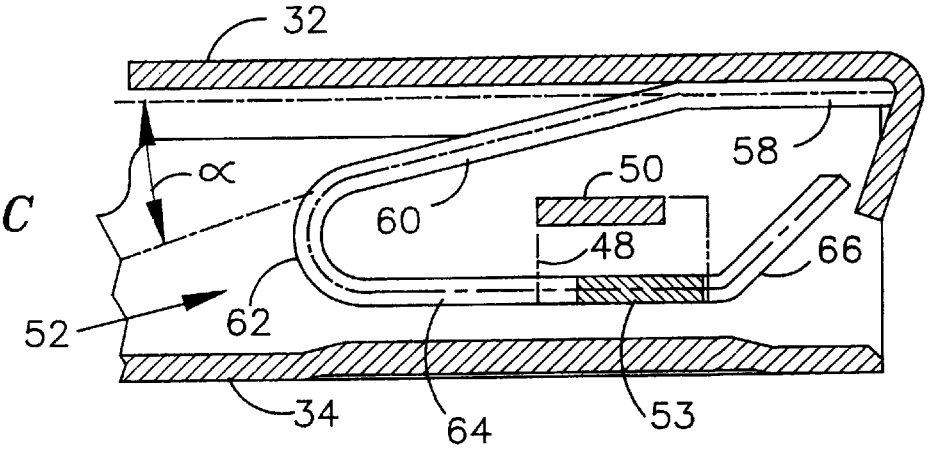

FIG. 4C illustrates the contact spring member 52 in its preloaded and sized state. Sizing the preloaded contact spring member changes the first angle α' to a smaller first angle α, by pivoting second portion 60 about secondary pivot point $P_2$ until the contact portion 64 is substantially parallel to the raised contact surface 44, as shown in FIG. 4C. This sizing may be done by inserting a sizing blade of a thickness sufficient to achieve the desired first angle and consequently blade pathway height "h". The predetermined maximum blade pathway height, and consequently the sizing blade thickness is determined experimentally.

By sizing contact spring member 52 the desired insertion force is set. In the present embodiment, the desired insertion force is approximately 4 Newtons. If contact spring member 52 is not sized prior to the first insertion of blade member 74, then upon the first insertion of blade member 74, the first insertion force will spike to a substantially higher insertion force than desired. If not sized, upon the first insertion of blade member 74 the insertion force would be approximately 10 Newtons in the present embodiment. The sizing of contact spring member 52 removes the initial spike, but is not necessary for operation of contact spring member 52 as sizing will occur upon the first insertion of blade member 74. Lip 50 provides contact spring member 52 with protection from becoming over-stressed upon sizing, or upon the first insertion if not sized. Lip 50 prevents contact spring member 52 from being moved past a predetermined distance which would place the spring member 52 in an overstressed state as described hrein. If a male blade thick enough to force the contact spring member above $H_L$ is inserted into the terminal, the interior surface of the contact portion 64 will contact the lip 50, and the lip will stop the upward movement of the spring and consequently the insertion of the male blade member.

In the present embodiment, the first angle α' prior to sizing is preferably larger than the angle α after preloading and sizing because the contact spring member has been purposely overstressed at $P_2$ when sized suring manufacture and the angle has therefore decreased. In the present embodiment, the second angle θ is preferably between about 30° and about 45° for a 1.5 mm electrical terminal because this size angle enables guidance of the male blade downward into the blade pathway 73.

Figures 5A, 5B, 5C, 5D, 5E:
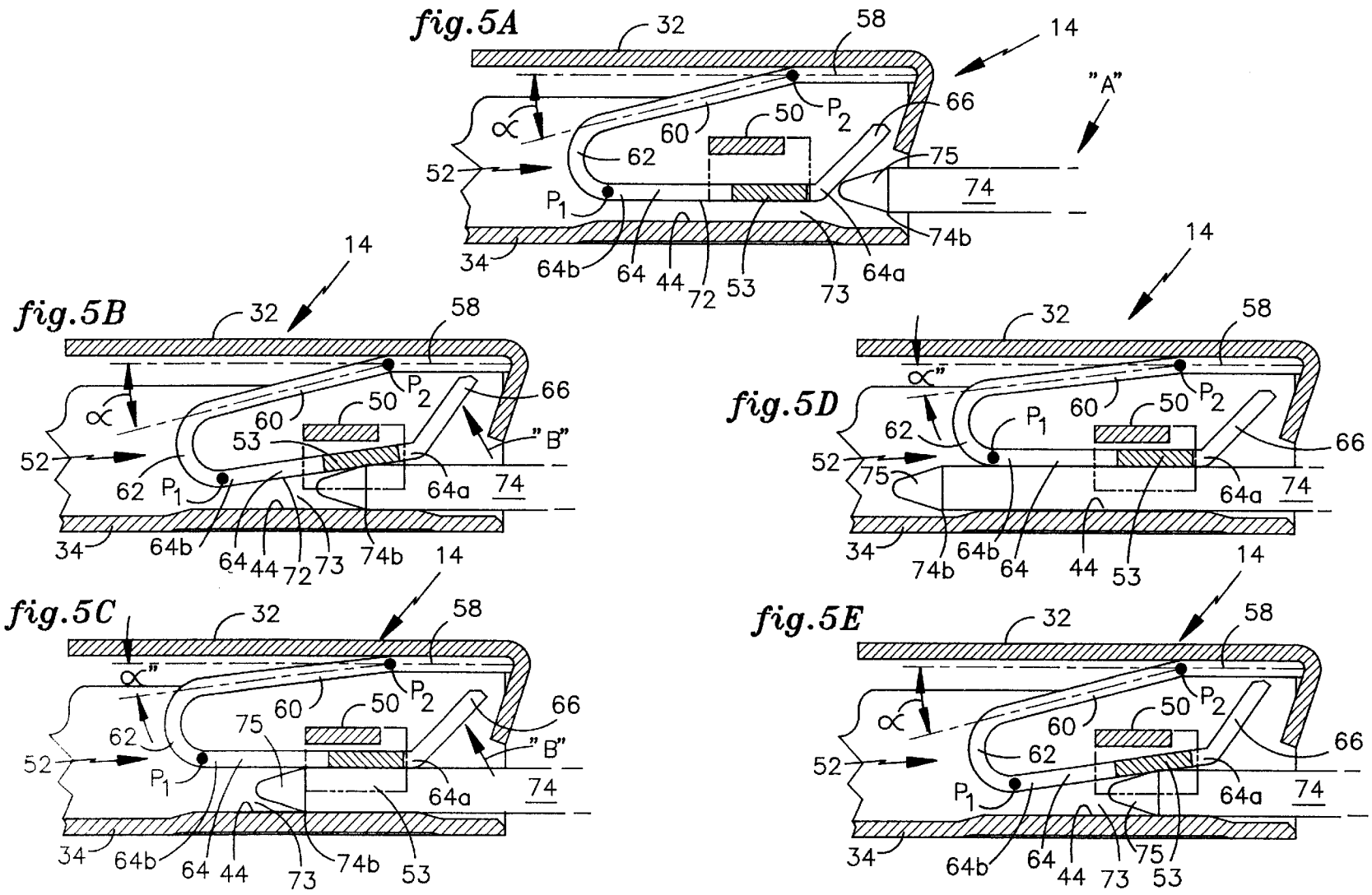
FIGS. 5A, B, C, D and E are partial views of the body portion of the electrical terminal of FIG. 1 in various modes of operation.

The operation of terminal 10 will now be described. Referring now to FIGS. 5A, B, C, D and E, there is illustrated partial views of the body portion 14 of the electrical terminal 10 of FIG. 2 in various modes of operation. FIG. 5A shows the contact spring member 52 of the present application after preloading and sizing and prior to insertion of an approximately 0.81 mm thick male blade member 74 into the blade pathway 73. In the present embodiment prior to insertion of male blade member 74 first angle α is preferably approximately 19.7°. Upon insertion of blade member 74 into terminal 10, wedge-shaped blade member tip 75 contacts loading ramp portion 66. The positioning of the loading-ramp portion 55 at the second angle θ (FIG. 3) guides the male blade member 74 in a downward direction as represented by arrow "A" into blade pathway 73.

Referring now to FIG. 5B, there is illustrated the contact spring member 52 of the present application after the male blade member 74 has been inserted to less than half the length of contact portion 64 into pathway 73, as measured from the thickest point 74*b* of blade member 74. As blade member 74 enters pathway 73 it engages the exterior contact surface 72 and the raised contact surface 44. Because the thickness of the male blade is greater than the height "h" of pathway 73, it causes loading ramp portion 66, and consequently first end 64*a* of contact portion 64, to pivot upward in the direction of arrow "B", about primary pivot point $P_1$, as shown in FIG. 5B. As the male blade member is further inserted into the pathway 73, toward the half-way point of contact portion 64, the contact portion continues to move upward about pivot point $P_1$ in the direction of arrow "B" and contact spring member 52 continues to exert minimal resistance to this movement upon the male blade. In this position, loading ramp portion 66 and consequently the contact portion 64 have pivoted about pivot point $P_1$ such that contact portion 64 is no longer substantially parallel with raised contact surface 44. In the present embodiment, as represented in FIG. 5B, substantially no movement of contact spring member 52 about secondary pivot point $P_2$ has occurred prior to the insertion of blade member 74 at least approximately half-way into pathway 73. Therefore, a removal force equal to or greater than the insertion force of blade member 74 has not yet been achieved at this point of insertion.

FIG. 5C shows the contact spring member 52 of the present application after the male blade member 74 has been inserted to approximately half the length of contact portion 64 into pathway 73. As illustrated in FIG. 5C, upon insertion of blade member 74 to approximately half the length of contact portion 64 into pathway 73, second end 64*b* of contact portion 64 is pivoted about secondary pivot point $P_2$ in the direction of arrow "B", thereby curved portion 62 and second portion 60 are also pivoted about pivot point $P_2$ which results in angle α being decreased to angle α". The pivoting about the primary and secondary pivot points $P_1$, $P_2$ is the "toggle" movement referred to hereinabove. The "toggle" movement is substantially complete when contact portion 64 once again becomes substantially parallel to raised contact surface 44. When blade member 74 reaches approximately the at least half-way insertion point and contact portion 64 is substantially parallel to the raised contact surface 44, contact portion exerts a contact pressure on male blade member 74 such that the removal force of blade member 74 will be substantially equal to or greater than the insertion force of the blade member, as desired. This is a desirable feature because it helps ensure that electrical contact of the blade member 74 is maintained with the terminal 10, even if the blade member 74 is not fully inserted within the terminal.

FIG. 5D shows the contact spring member 52 of the present application after full insertion of the male blade member 74 into the body portion 14. The positioning of the contact spring member 52 at full insertion of blade member 74 is substantially the same as at the half-insertion of blade member 74. Therefore, as with half-insertion, the removal force of blade member 74 will be substantially equal to or greater than the insertion force of the blade member. The desired insertion force of blade member 74 of the present embodiment is between approximately 2–5 Newtons with 4 Newtons being the preferred insertion force. The desired removal force should be substantially equal to or greater than the insertion force, and in the present embodiment is preferably about 4 Newtons. The insertion and removal forces will be affected by the geometry of the contact spring member, number of terminals disposed in the housing, the material selection and plating of the blade member and other factors which would be known to one skilled in the art.

FIG. 5E illustrates the contact spring member 52 of the present application during removal of the male blade 74, after more than half of the male blade 74 has been removed from the body portion 14 and the blade has returned to the position of FIG. 5B where the removal force is no longer greater than or substantially equal to the insertion force. Operation of contact spring member 52 during removal will be the reverse of the insertion process described hereinabove. Until blade member 74 has been removed passed approximately the half length of contact portion 64, the contact portion 64 remains substantially parallel to the raised contact surface 44, thus allowing contact pressure to be exerted on the male blade member 74 and the friction forces to remain at a level that helps keep removal forces substantially equal to or higher than the insertion forces. Upon passing the half-length mark, contact spring member 52 will first pivot about secondary pivot point $P_2$ and then primary pivot point $P_1$, in the toggle motion described hereinabove until returning to the initial position of FIG. 5A.

Referring now to FIG. 6, there is illustrated a plan view of a sheet metal blank 100 from which the electrical terminal 10 of FIG. 1 is formed. In the preferred embodiment the electrical terminal of the present application is a unitary metal structure which is stamped out of a sheet metal and then inwardly folded by use of progressive dies and metal scoring. In the present embodiment approximately 30 different tooling function are utilized to form the electrical terminal 10 of FIG. 1. As a result of this unitary design, the body portion is electrically connected to the base 16 of the wire connection portion as a single structure.

Because the preferred embodiment is a unitary structure the metal used must be both a high yield material and a high strength material, since the material must form both the contact spring member and the body-portion. Recommended materials satisfying these characteristics are berillium copper 17410, ½ HT temper manufactured by Brush Wellman. The most preferable material with the necessary properties is a copper alloy commercially available and manufactured by Olin Brass under the name C7025 TM02, because it is relatively inexpensive as compared to other appropriate materials such as the berillium copper. The terminal of the present application is also preferably coated with a conductive plating to protect against corrosion, for example, a commercially available tin plating.

Figure 7:
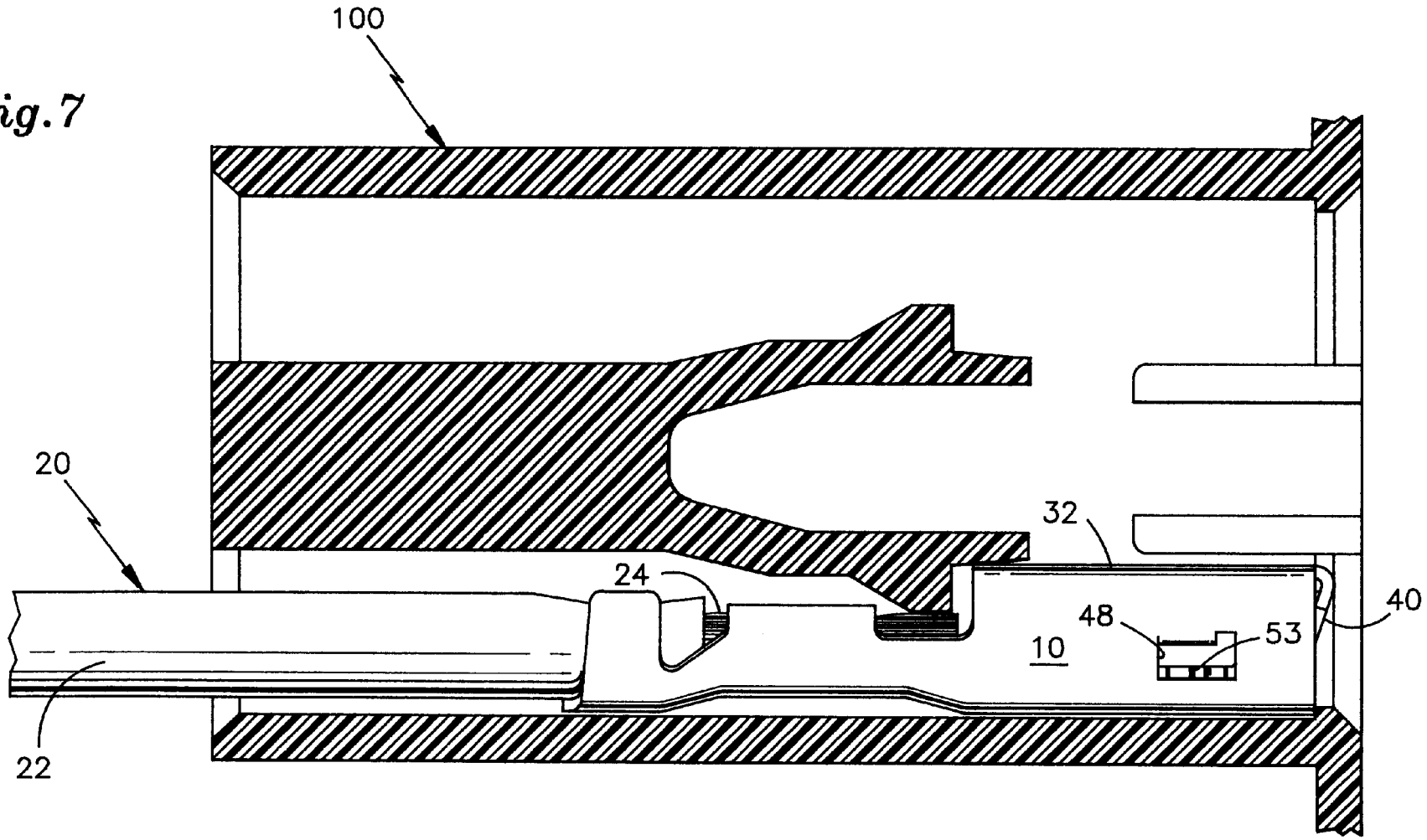
FIG. 7 is a side elevational view of FIG. 1 disposed within housing.

Referring now to FIG. 7, there is illustrated electrical terminal 10 disposed within housing 100. Terminal 10 is preferably designed to interact with a housing 100, the housing operating to act as an insulator between multiple circuits.

The electrical terminal of the present application has a number of advantages. The principal advantages are that the terminal requires low insertion forces while providing a high contact pressure and a removal force substantially equal to the insertion force. In an electrical terminal a high contact pressure is desired to achieve good electrical contact between the blade member and the terminal. In the present application, the design of the contact spring member as described hereinabove exerts a contact force on the male blade sufficient to hold the blade member in good electrical connection with the second wall of the terminal. This electrical connection allows an uninterrupted current to flow between the male blade, the electrical terminal (via the second wall) and the the conductive wire. Having a sufficiently high contact pressure further helps decrease the chance of film build-up of moisture and oxides which can form at lower contact pressures and act to interrupt the current path. In addition, as the contact pressure decreases the sensitivity of the terminal to vibration increases which can disengage the blade member, thereby interrupting the current path, or at least causing a noisy circuit. Typically the insertion force is directly proportional to the contact pressure thus as higher contact pressures are achieved, the insertion forces increase.

It is desired that for manufacturing purposes the insertion forces should be as low as possible, therefore a balance must be struck between the insertion forces and the increased contact pressure. The high contact pressure is a function of beam geometry, preloading the beam, sizing the beam and material selection. In the present design, the insertion force of the blade member is low, while the contact pressure is high, thus optimizing both elements. This optimization of both elements is achieved in the present embodiment by the particular design geometry of the contact spring member, with specific reference to the incorporation and location of the pivot points and the location of the curved portion 62 adjacent the exit end 28, as described hereinabove. The present design allows the loading ramp 66 and hence the contact spring member to offer little resistance to the male blade initially upon entry. The present application allows a 1.5 mm terminal to provide contact pressures of between about 8N and 10N to be achieved with insertion forces between about 2N and 5N, with 4N being the preferred insertion force.

The removal force is substantially equal to or greater than the insertion force in the present application. This is achieved by having a lower coefficient of friction on insertion than on removal. As shown in FIG. 5B, upon initial insertion, the surface area of the blade member which is contacting the spring member is less than the surface area of the blade member contacting the spring member when removal begins somewhere between full and half insertion of the blade member as shown in FIGS. 5C and 5D. The difference in contact surface is due to the fact that on insertion the male blade is not in full contact with the exterior contact surface 72 until at least half insertion has been achieved, while on removal the male blade is in full contact with the exterior contact surface until it passes the half removal point as described hereinabove. Since surface area is directly proportional to the coefficient of friction, the surface area on removal is initially greater than surface area on insertion which leads to a higher coefficient of friction on removal and thus a higher removal force.

Another advantage of the present design is that it is durable, has good repeatability, i.e. allows the male blade to be inserted a number of cycles without causing fatigue of the spring contact member, and allows the terminal to accept a number of varying blade thicknesses. The durable design is achieved in part by the inclusion of the cooperable locking device which retains the terminal in its box-like configuration and the four-sided design which protects the contact spring member from its environment. With respect to repeatability, it can be seen that upon removal of the male blade member the contact member returns to the initial state as shown in FIG. 5A. Upon reinsertion of a blade member the insertion force, contact pressure, and removal force remain constant for a number of cycles. Experiments have shown little or no fatigue to the contact spring for approximately 100 cycles. The ability of the contact spring member to return to initial state, substantially unharmed is due to the geometry of the electrical terminal, as well as, the material used for the terminal. Both allow the design of the terminal to be within elastic limits thereby enabling the return of the contact spring member to its initial position. The design is also enhanced by two preferred but not necessary features, the lip 50 and the loading ramp 66. The height of the lip 50 protects the contact spring member from being overstressed. If a male blade thick enough to force the contact spring member above $H_L$ is inserted into the terminal, the interior surface of the contact portion 64 will contact the lip 50, and the lip will stop the upward movement of the spring and consequently the insertion of the male blade member. This prevents overstress of the contact spring member which could lead to breaking or crushing of the contact spring member thereby making the terminal useless. In addition the loading-ramp portion serves to prevent damage to the interior surfaces of the contact spring member by guiding the blade member downward, as described hereinabove, thereby preventing penetration of the blade into the interior portion of the contact spring member. Any damage to the interior surfaces by the male blade could make the contact spring member inoperable.

Another advantage of the present application is its ability to function with a variety of male blade lengths and to function at less than full blade insertion. Both of these advantages are achieved by the "toggle" movement which allows sufficient contact pressure to be applied once the male blade reaches the half way point of the contact portion, as described hereinabove.

The electrical terminal of the present application is also advantageous because it operates well electrically due to the raised contact surface which aids in allowing the current path from the second wall to the wire connection portion to be direct and uninteruppted, as well as the material selected for the terminal. The uninterrupted current path is enhanced and kept uniform throughout manufacturing by producing the raised contact surface. Material buildup in the seams between the third and fourth walls and the second wall, can prevent the male blade from contacting the second wall. Thus, use of the raised contact surface serves to ensure an electrical connection between the male blade and the second wall within each and every electrical terminal.

It will be understood that various modifications may be made to the embodiments disclosed herein. For example, the electrical terminal may be manufactured by using more than one part, such as a component including the body-portion and the wire connection portion and a separate attachable contact spring member. Furthermore, the contact spring member of the present invention may be employed to retain fuses, metal frets, printed circuit board connectors, or any other electric current carrying member. The body portion construction of the present invention may be used without the loading-ramp portion, the raised contact area, the entry flap or the cooperable locking device. A variety of materials may also be utilized and the insertion and removal forces may vary depending upon material selection. Therefore, the above description should not be construed as limiting, but merely as exemplifications of preferred embodiments. Those skilled in the art will envision other modifications within the scope and spirit of the claims appended hereto.

We claim:

1. An electrical terminal operatively associated with a blade member, said electrical terminal comprising:

a wire connection portion; and a body portion defining an interior chamber and electrically connected to said wire connection portion, said body portion including:
an entry end;
an exit end opposed to said entry end;
an opening in said body portion; and a movable spring member substantially disposed within the interior chamber, said movable spring member being attached to said body portion at one end, said movable spring member including:
a primary pivot point;
a secondary pivot point;
a curved portion adjacent said exit end;
a contact portion extending from said curved portion toward said entry end, said contact portion being pivotable about said primary pivot point upon insertion of said blade member; and
a preloading tab extending from said contact portion, such that in a preloaded state said tab extends through said opening.

* * * * *